US005506013A

United States Patent [19]

Lesnik

[11] Patent Number: 5,506,013

[45] Date of Patent: Apr. 9, 1996

[54] PLASTIC FOAM NOVELTY ITEMS

[76] Inventor: Yuris E. Lesnik, c/o Art Windows Gallery 316 N. Michigan Ave., Chicago, Ill. 60601

[21] Appl. No.: 339,808

[22] Filed: Nov. 15, 1994

[51] Int. Cl.[6] ..... B29D 22/00

[52] U.S. Cl. ..... 428/36.5; 428/15; 83/39; 83/49; 446/72; 446/385

[58] Field of Search ..... 428/36.5, 15; 446/72, 446/385, 486, 487; 83/39, 49

[56] References Cited

U.S. PATENT DOCUMENTS 4,226,046 10/1980 Delhome ..... 46/123

*Primary Examiner*—Romulo H. Delmendo

*Attorney, Agent, or Firm*—John G. Premo

[57] ABSTRACT

A resilient solid foam object which has a part of its outer surface scribed with a series of connected cuts. These cuts communicate with the interior of the foam object. The cuts are arranged to allow the foam object to be turned inside out and are shaped to form a three dimensional structure within the solid foam object. The three dimensional object is displayed upon turning the solid foam object inside out. Also described is a method for making these novel foam objects.

11 Claims, 4 Drawing Sheets

PLASTIC FOAM NOVELTY ITEMS

FIELD OF THE INVENTION

The invention relates to novelty items made from solid plastic foams and their method of production.

THE INVENTION

The invention in its broadest aspect comprises a resilient solid foam object which has contained therein a three dimensional structure which is displayed when the object is turned inside out. More specifically, the invention relates to a resilient solid foam object having a part of its outer surface scribed with a series of connected cuts. These cuts communicate with the interior of the resilient solid foam object and allow the resilient solid foam object to be turned inside out. The cuts are shaped to form a three dimensional structure within the resilient solid foam object which is displayed upon turning the solid foam object inside out.

The invention is particularly directed to whimsical four legged animal shapes,such as dogs, although other shapes have been created. When the resilient foam objects are four legged animals,the resilient solid foam object is a cube which has, on its top surface near the four corners four leg cuts which extend into the interior of the cube. Also present on the top of the cube are straight cuts which connect the leg cuts to form an equisided cross within the area defined by the four legs. The straight cuts also extend into the interior of the cube and define a compressed, inverted shape of a four legged animal which is displayed when the cube is turned inside out. When the animal is a dog the leg cuts are oval in shape and the sides of the equisided cross are arcuate.

The foam used to make the resilient solid foam object may be selected from a large number of solid resilient foams. Foams such a cellulosic or other synthetic plastic foams may used. The foams should be sufficiently resilient to posses a degree of plastic memory so that they return to their original shape after repeated deformations. Examples of such solid plastic foams are the polyurethanes and modified polyurethanes such as the polyether polyurethanes or the polyester polyurethanes. Also useful are the resilient foamed polyethylenes, foamed mylars and the like. Foamed natural and synthetic elastomers may also be used. A preferred group of plastic foams are the polyester polyurethane foams of the type available commercially from Foamcraft, Inc. and are sold under the trade designation "#20000 Polyester Polyurethane". The resilient solid foam object should have pores sufficiently dense so as to allow ready working of the foam with a sharp cutting instrument such as a razor blade. The pores of the foam may be connected as in a sponge, thus allowing the absorption of water to occur.

The shape of the resilient solid foam object may be selected from a variety of three dimensional shapes such as free form or geometric shapes. Geometric shapes such as cubes, spheres, pyramids, cylinders, cones, rectangular blocks and the like represent preferred shapes. For producing the novelty type shapes resilient solid foam cubes are preferred.

The products of the invention will be novelty items, toys, company logos and characters. The invention is capable of producing a variety of objects that could be used as toys for a wide age group of children.

The products of the invention are unique in that the original shape of the starting resilient foam object is not altered in appearance save for nearly invisible cuts made in the object during its fabrication. The three dimensional structure is an integral part of the resilient solid foam object. In a preferred embodiment of the invention, this unity of structure between the resilient solid foam object and the three dimensional structure positioned within the resilient solid foam object is achieved by using a special cutting technique which is called "contour field" or "clear field" cutting.

Contour field cutting is a new technique for providing products from foam and other soft materials using the entire mass of material and its interior dimensions by creating a design that renders up an entirely new form without wasting any of the existing material. This particular cutting technique produces within the resilient foam object the three dimensional structure in a compressed inverted form. By compressed form is meant that the three dimensional structure is partially folded or slightly deformed while it is contained within the resilient solid foam object. Contour field cutting has the further advantage that it requires only a very small amount of foam to be removed as scrap. The amount of waste produced by the contour or clear field cutting technique does not exceed 5% by weight of the starting resilient foam shape.

The invention also relates to a method for producing the resilient foam objects described above. Specifically the method comprises the steps:

a. making on a part of the outer surface of the resilient solid foam object a series of connected cuts which extend into the interior of the solid foam object;

b. arranging the cuts so as to allow the solid foam object to be turned inside out and to define the outer contours of a three dimensional structure:

When it is desired to produce a four legged animal within the resilient foam objects which are in the form of a cube then the process comprises the steps:

a. making on the top surface of the cube near the four corners four leg cuts which extend into the interior of the solid foam cube;

b. making straight cuts which connect the leg cuts to form a equisided cross within the area defined by the four leg cuts. The straight cuts also extend into the interior of the resilient solid foam cube. This produces within the solid foam cube the four legged animal in a compressed and inverted form: and, optionally the additional steps of, c. making a neck cut to further free the four legged animal when the cube is turned inside out, and, d. trimming the four legged animal to provide better definition.

When it is desired to produce a foam dog the leg cuts are oval and the sides of the equisided cross are arcuate.

BRIEF DESCRIPTION OF THE DRAWINGS

In the drawings like parts have like numbers. For purposes of clarity not all similar parts have been repetitively numbered.

DETAILED DESCRIPTION OF THE INVENTION

Figure 1:
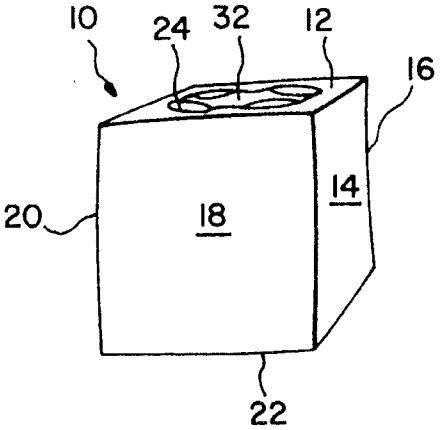
FIGS. 1–7 and 1A–7A are corresponding vertical and horizontal plan views showing the steps used in forming a resilient foam whimsical dog.
Figure 2:
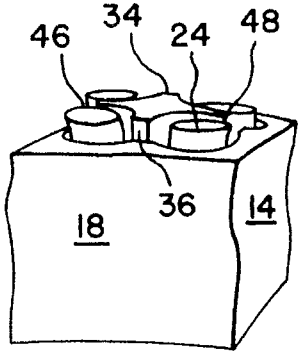
Figure 3:
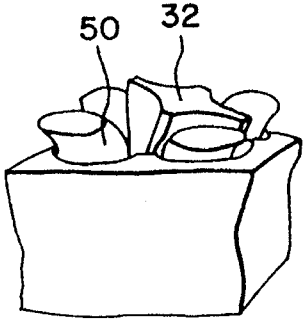

With reference to the drawings and in particular FIGS. 1 and 1A and 2 and 2A there is shown a 2 inch resilient foam cube 10. It has a top 12 a front face 14 right side 16 left side 18 back 20 and bottom 22.

Figure 9:
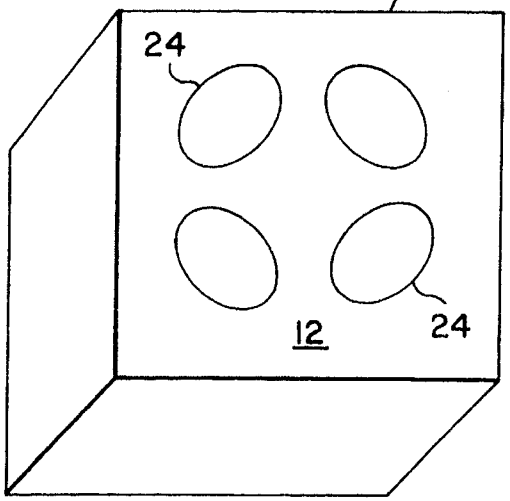
FIG. 9 Is a perspective top view of the cube showing the leg cuts made by the jig in FIG. 8.
Figure 8:
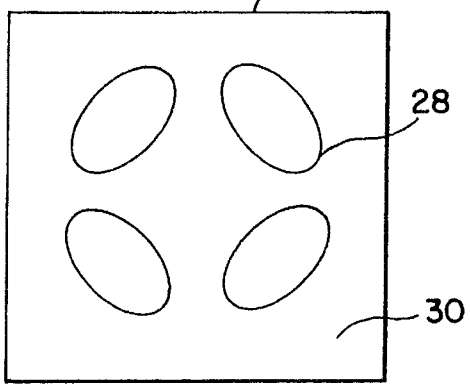
FIG. 8 is a top view of a jig used to form the legs of the dog shown in FIGS. 1–7 and 1A–7A.

Scored within the top 12 near its four corners are four oval leg cuts 24. To make these cuts the cube 10 is gathered or bunched using moderate pressure on its four sides to create a more dense top 12 of the cube 10. Top 12 is then cut using the jig shown in FIG. 8. This jig 26 contains four oval shaped knives 28 vertically positioned on the top 30 of jig 26. These knives are positioned to correspond to the desired shape and spacing of the leg cuts 24. The resulting oval cuts form on the surface of the cube 10 segments which are arcuate and are shown to best advantage in FIG. 9.

The cut in top 12 is made by pressing it down ¾" onto the oval shaped knives 28 of the jig 26. After the leg cuts are made a sharp cutting tool such as a razor is used to make a series of connecting straight cuts 34 and 46 which connect the leg cuts 24 so as to define an equisided arcuate cross 32. The straight cuts form a small rectangular tip 36 which feature is shown to best advantage in FIGS. 2 and 2A.

Figure 6:
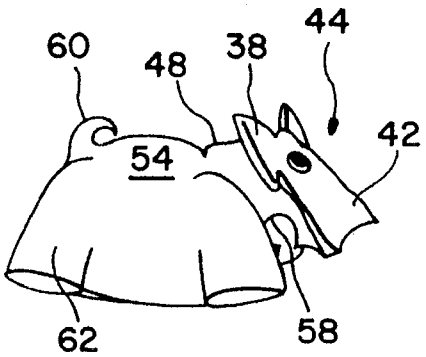
Figure 6A:
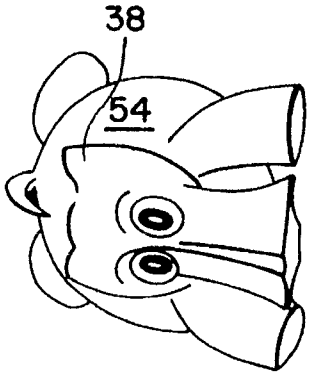
Figure 5:
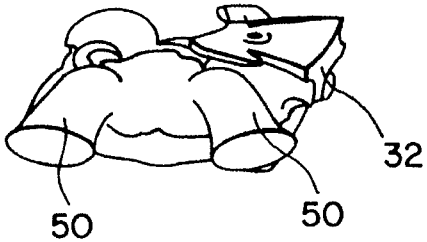
Figure 5A:
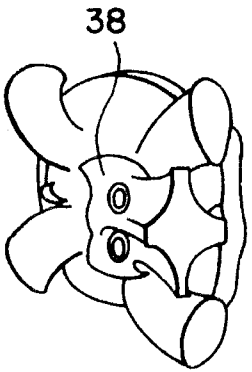
Figure 10:
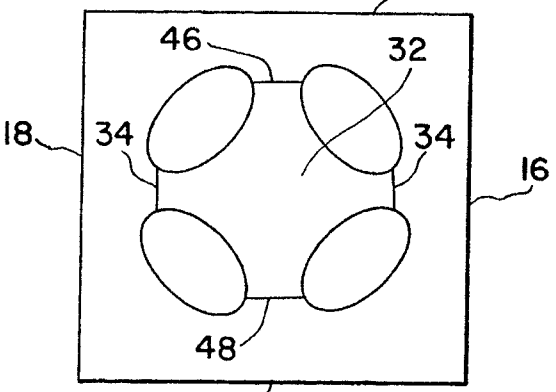
FIG. 10 Is a top view corresponding to FIG. 9 showing the straight cuts which connect the leg cuts.

These cuts are made by first selecting two opposite sides 16 and 18 which will become the sides of the dog. On the equisided arcuate cross 32 nearest each side 16 and 18, a straight cut 34 is made which cut is made at a 70 degree angle which slopes towards the interior of the cube 10. These two cuts will form part of the ears 38 of the dog 40. This feature is shown to best advantage in FIGS. 6 and 6A. The other two straight cuts are made at the front 14 and the back 20 of the cube 10. The resulting cuts 34 are shown to best advantage in FIG. 10.

Front 14 of cube 10 is selected as the front 42 of the dog's head 44. This feature is also shown most effectively in FIGS. 6 and 6A. Looking down on the top 12 of the cube 10, a first straight cut 46 is made to connect the two arcuate cuts that form the dogs head 44. This cut will form the nose of the dog and is made one inch deep and in an inward sloping, quarter circle fashion. The last cut on the top 12 of cube 10 is made by connecting with a second straight cut 48 the two arcuate cuts which will form the back of dog's head 44. This cut is ½" deep and is made parallel to back 20 of cube 10. The resulting cuts 46 and 48 are shown to best advantage in FIG. 10. As indicated, the arcuate leg cuts 24 and the rectangular tip cuts 36 form an equisided arcuate cross. At this point in the construction of the dog 40 it is possible to partially free the rough shape of the dog 40 from cube 10 by partially turning the cube inside out. This partial release of the sculpture from the cube is shown in FIGS. 2–4 and 2A–4A.

Figure 4:
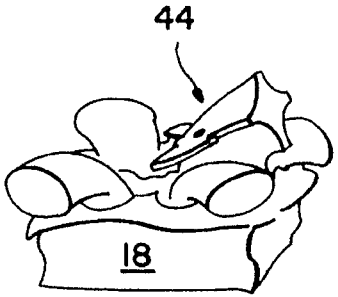
Figure 1A:
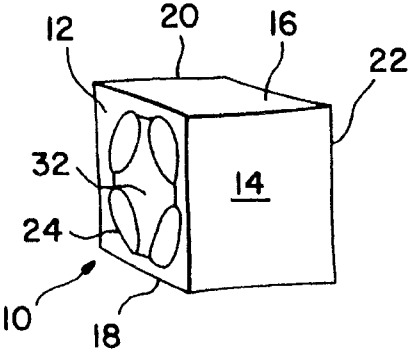
Figure 2A:
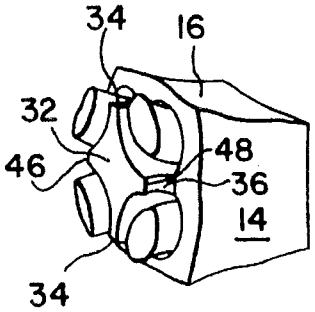
Figure 3A:
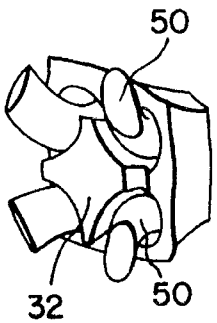
Figure 4A:
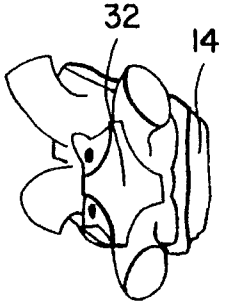
Figure 7:
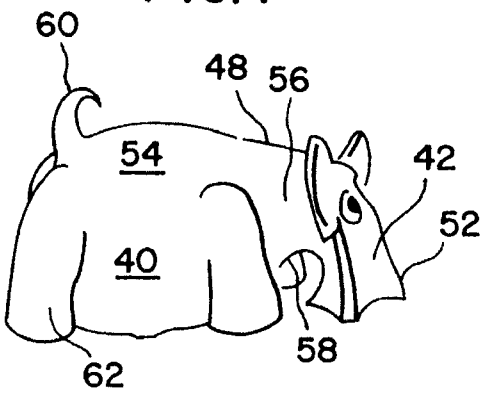
Figure 7A:
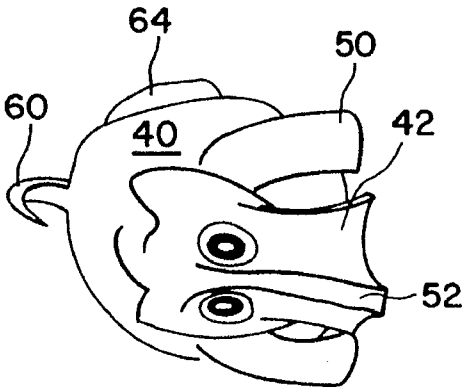

The equisided arcuate cross 32 will protrude upwardly exposing the ears 38 and head 44 of dog 40. The leg cuts 24 will protrude upward revealing the legs 50 of dog 40. Where the back of the head 44 of the dog 40 is joined to cube 10 a one inch deep cut is made parallel to the bottom 20 of cube 10. This will free the head of the dog 40 from cube 10 and the dog's head 44 will protrude upwardly. This is best seen in FIGS. 4 and 4A. The dog 40 is now ready to be completely turned inside out, revealing four legs 50, its body 54, neck 56 and head 44. The complete transformation is best seen in FIGS. 6–7 and 6A–7A.

Figure 12A:
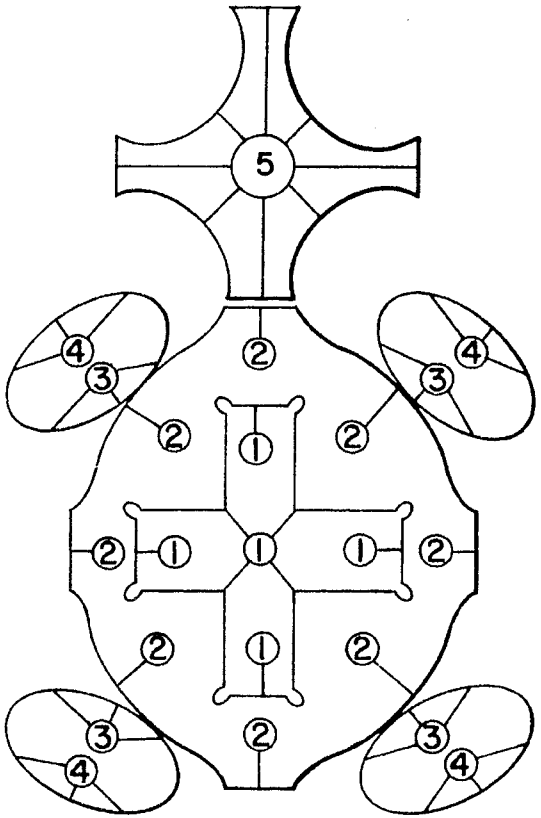
FIG. 12A is a bottom view showing the bottom of the cube turned inside out and illustrates the mirror image of the parts using numbers corresponding with the numbers in FIG. 12
Figure 12:
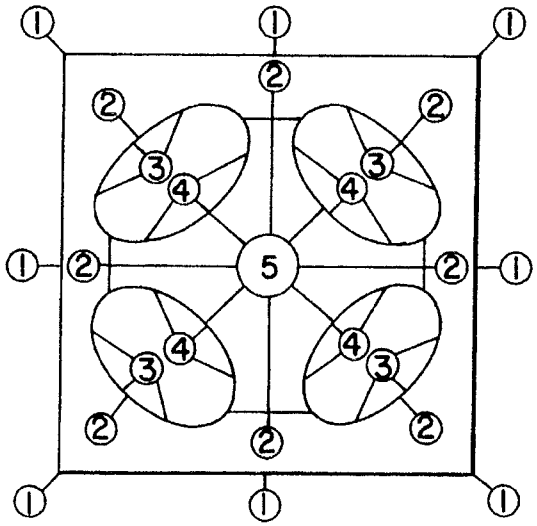
FIG. 12 is a top view of the cube showing by numbers the various segments and cuts which form the dog prior to the cube being turned inside out.
Figure 11:
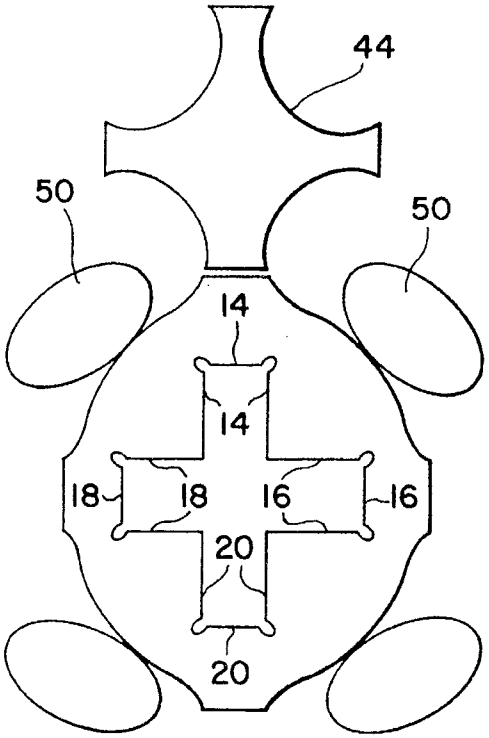
FIG. 11 is a bottom view of the foam dog turned inside out.

FIG. 11 shows the underside of the dog 40 after it has been turned inside out. FIGS. 12 and 12A illustrate how the exterior and interior surfaces of the cube 10 reverse after the transition from cube 10 to dog 40. Specifically, the perimeter of the cube 10 is defined by a series of the numeral 1. The various faces of the legs 50 are represented by the numerals 2,3 and 4. The numeral 5 is the center of equisided arcuate cross 32. FIG. 12 shows the foam cube in its compressed form. FIG. 12A shows the cube in FIG. 12 turned inside out to produce the dog 40. It is apparent all of the parts shown in FIG. 12 are reversed in FIG. 12A.

The legs 50 are given more definition by trimming each leg where it connects with the body, so that a right angle is formed where the legs join the body 54. The top and sides of the are trimmed of a small amount of material so the body 54 is rounded into a half sphere. The underside 58 of the dog's neck 56 is cut away from the body by cutting ¼ inch opening through the neck so that the bottom of the opening causes the head 44 to extend away from the body 54 of the dog 40.

A tail 60 is formed by pinching the rear legs 62 and 64 against the sides of the dog's body 54, causing the back end of the dog 40 to protrude outwardly. A cut is made 1/16 inch deep and ¼ inch wide perpendicular to the plane formed by the rear legs 62 and 64, which cut is made at a 45 degree angle sloping towards the top of the dogs' body 54. To further decorate the dog 40 white silicone eyes are affixed to the front of the dog's head 44 on either side of the nose 52.

I claim:

1. A resilient solid foam cube having, on its top surface near the four corners four leg cuts which extend into the interior of the cube; straight cuts which connect the leg cuts to form a equisided cross within the area defined by the four legs; which straight cuts also extend into the interior of the cube and define a compressed, inverted shape of a four legged animal which is displayed when the cube is turned inside out.

2. The resilient solid foam cube of claim 1 where the foam is a urethane foam, the leg cuts are oval and the sides of the equisided cross are arcuate.

3. The resilient solid foam cube of claim 2 where the four legged animal is a dog.

4. A method of forming a three dimensional structure which is a novelty within the interior of a resilient solid foam object without altering the appearance of the resilient solid foam object and with the three dimensional structure being an integral part of the resilient solid foam object which three dimensional structure is displayed when the resilient solid foam object is turned inside out which comprises the steps:

a. making on a part of the outer surface of the resilient solid foam object a series of connected cuts which extend into the interior of the solid foam object;

b. arranging the cuts so as to allow the solid foam object to be turned inside out and define the outer contours of the three dimensional structure.

5. The method of claim 4 where the foam is a polyurethane foam and the cuts defining the outer contours of the three dimensional structure are made to produce within the solid foam object the three dimensional structure in a compressed inverted form.

6. The method of claim 4 where the shape of the solid foam object is geometric.

7. The method of claim 6 where the solid foam object is a cube.

8. A method of forming a four legged animal within the interior of a resilient solid foam cube which four legged animal is displayed when the resilient solid foam cube is turned inside out which comprises the steps:

a. making on the top surface of the cube near the four corners four leg cuts which extend into the interior of the solid foam cube;

b. making straight cuts connecting the leg cuts thereby forming a equisided cross within the area defined by the four leg cuts which straight cuts extend into the interior of the resilient solid foam cube,thereby defining the outer contours of the four legged animal and to produce within the solid foam cube the four legged animal in a compressed inverted form.

9. The method of claim 8 where there is a step c which comprises turning the cube inside out and making a neck cut to further free the head of the four legged animal.

10. The method of claim 8 where there is a step d which comprises trimming the four legged animal.

11. A method of forming a four legged dog within the interior of a resilient solid polyurethane foam cube which dog is displayed when the resilient solid foam cube is turned inside out which comprises the steps:

a. making on the top surface of the cube near the four corners four oval leg cuts which extend into the interior of the solid foam cube;

b. making arcuate cuts connecting the leg cuts thereby forming a equisided cross within the area defined by the four leg cuts which arcuate cuts extend into the interior of the resilient solid foam cube,thereby defining the outer contours of the dog and to produce within the solid foam cube the dog in a compressed inverted form;

c. turning the cube inside out and making a neck cut to further free the head of the dog; and then, d. trimming the dog.

* * * * *